US007385831B2

(12) United States Patent
Ito et al.

(10) Patent No.: US 7,385,831 B2
(45) Date of Patent: Jun. 10, 2008

(54) POWER SUPPLY DEVICE AND VEHICLE LAMP

(75) Inventors: Masayasu Ito, Shizuoka (JP); Kentarou Murakami, Shizuoka (JP); Hitoshi Takeda, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 356 days.

(21) Appl. No.: 11/144,865

(22) Filed: Jun. 3, 2005

(65) Prior Publication Data

US 2005/0269968 A1 Dec. 8, 2005

(30) Foreign Application Priority Data

Jun. 7, 2004 (JP) ..... 2004-169166

(51) Int. Cl.
*H02M 3/335* (2006.01)
*H02M 7/122* (2006.01)

(52) U.S. Cl. ..... 363/21.09; 363/21.04; 363/56.01

(58) Field of Classification Search ..... 363/16, 363/20, 21.01, 21.04, 21.07, 21.09, 56.01, 363/56.09, 56.1, 56.11; 307/9.1, 10.1, 10.8, 307/12, 17, 31–35; 315/185 R, 192, 201, 315/210, 228, 291, 294, 312
See application file for complete search history.

(56) References Cited

U.S. PATENT DOCUMENTS 5,363,323 A * 11/1994 Lange ..... 363/21.09
5,736,881 A * 4/1998 Ortiz ..... 327/175
6,369,525 B1 * 4/2002 Chang et al. ..... 315/300
6,434,027 B1 * 8/2002 Sano et al. ..... 363/21.16
7,105,945 B2 * 9/2006 Shiotsu et al. ..... 307/10.8
2003/0128555 A1 7/2003 Schemmann et al.

FOREIGN PATENT DOCUMENTS

| | | |
|---|---|---|
| EP | 1 337 032 | 8/2003 |
| JP | 61-266068 | 11/1986 |
| JP | 7-303373 | 11/1995 |
| JP | 11-68161 | 3/1999 |
| JP | 2002-231013 | 8/2002 |

OTHER PUBLICATIONS

Patent Abstracts of Japan, Publication No. 2002-231013 dated Aug. 16, 2002, 2 pages.
Patent Abstracts of Japan, Publication No. 61-266068, Publication Date: Nov. 25, 1986, 1 page.
German Office Action issued in German Application No. 10 2005 025 902.2 mailed on Nov. 2, 2006 and English translation thereof, 8 pages.

* cited by examiner

*Primary Examiner*—Matthew V Nguyen
(74) *Attorney, Agent, or Firm*—Osha·Liang LLP

(57) ABSTRACT

A power supply device includes: a regulator transformer; a primary switch for selectively supplying a current to the regulator transformer; a control circuit for reducing to 0, following each election made at the primary switch, the minimum value of a current output by the secondary side of the regulator transformer; and a coupling transformer for magnetically coupling routes along which a plurality of loads are connected in parallel to the secondary side of the regulator translator in a direction in which magnetic flux along each of the routes is offset by a current change. In this case, the control circuit increases the maximum value of the output current on the secondary side larger than twice of the target value of the current supplied to the loads.

5 Claims, 10 Drawing Sheets

POWER SUPPLY DEVICE AND VEHICLE LAMP

The present application claims foreign priority based on Japanese Patent Application No. 2004-169166, filed Jun. 7, 2004, the contents of which is incorporated herein by reference.

BACKGROUND OF THE INVENTION

1. Technical Field

The present invention relates to a power supply device and a vehicle lamp.

2. Related Art

Conventionally, a vehicle lamp employing a light-emitting diode device is well known (see, for example, JP-A-2002-231013). When the vehicle lamp is turned on, the light-emitting diode element generates a forward voltage based on a predetermined threshold voltage at both ends.

A wide discrepancy appears in the forward voltage generated by individual light-emitting diode devices. Therefore, to cope with the discrepancy in the forward voltage, the vehicle lamp should be turned on by controlling the current for the light-emitting diode device. However, there is a case wherein, because of light distribution design, a vehicle lamp employs a plurality of light-emitting diode devices connected in parallel. In this case, wherein a separate circuit must be designated for supplying a current to each row, the circuit size would be increased, and accordingly, the cost of the vehicle lamp would be increased.

SUMMARY OF THE INVENTION

Accordingly, one or more embodiments of the present invention provide a power supply device and a vehicle lamp that employ a set of the features described in the independent claims of the present invention. The dependent claims of the invention specifically define additional effective examples for the present invention.

According to a first aspect of the invention, a power supply device comprises:

a regulator transformer;

a primary switch, for selectively supplying a current to the regulator transformer;

a control circuit for reducing to 0, following each election made at the primary switch, the minimum value of a current output by the secondary side of the regulator transformer; and a coupling transformer for magnetically coupling routes along which a plurality of loads are connected in parallel to the secondary side of the regulator translator in a direction in which magnetic flux along each of the routes is offset by a current change. Since each time a selection is made at the primary switch the control circuit reduces to 0 the minimum value of the current output by the secondary side of the regulator transformer, currents can be supplied at desired rates for a plurality of loads.

Further, the control circuit increases a maximum value for the current output by the secondary side until larger than twice the target value of the currents to be supplied to the loads. Thus, when the minimum value of the current on the secondary side is 0, the average value of the output current can easily approach the target value. In addition, since the control circuit changes switching frequencies in accordance with a voltage supplied by the primary side, the average current on the secondary side is maintained, regardless of the voltage supplied by the primary side. Thus, an average value for the current on the secondary side can be maintained, without the maximum value of the current on the secondary side being changed at the time an election is made using the primary switch. Accordingly, the power lost by the switching regulator can be minimized.

Furthermore, when a target value for a current to be supplied for the loads connected in parallel to the secondary side of the regulator transformer is increased, the control circuit reduces a switching frequency for the primary switch to increase the average current on the secondary side. Thus, on the secondary side, the average value of the current can be increased without the range of the increase in the current being changed at the time the primary switch is used to make an election.

In this case, regardless of the target value of the current to be supplied for the loads, or the supply voltage on the primary side, the control circuit is maintained substantially constant for a period wherein the current output by the secondary side is 0 during a switching cycle time. Thus, when the target value for the current is small, or when the supply voltage is high, the power loss can be reduced. Accordingly, for the power supply device, a temperature rise can be suppressed, a service life reduction can be prevented, and reliability can be improved.

According to a second aspect of the invention, a vehicle lamp comprises:

a regulator transformer;

a primary switch for selectively supplying a current to the regulator transformer;

a plurality of semiconductor light-emitting devices, connected in parallel to a secondary side of the regulator transformer;

a control circuit for reducing to 0, each time a selection is made using the primary switch, the minimum value of a current output by the secondary side of the regulator transformer; and a coupling transformer for magnetically coupling routes for the individual semiconductor light-emitting devices in a direction in which magnetic flux is offset by a current change. In this case, regardless of the target value of the current to be supplied for the semiconductor light-emitting devices, or the supply voltage on the primary side, the control circuit is maintained substantially constant for a period wherein the current output by the secondary side is 0 during a switching cycle time.

The summary above does not include descriptions of all the features or of all the sub-combinations of features that can be included without departing from the spirit of the invention.

DETAILED DESCRIPTION OF THE INVENTION

Embodiments of the present invention will now be described. Note, however, that the present invention is not limited to these embodiments, and not all the feature sets described in these embodiments are always required by the present invention.

Figure 1:
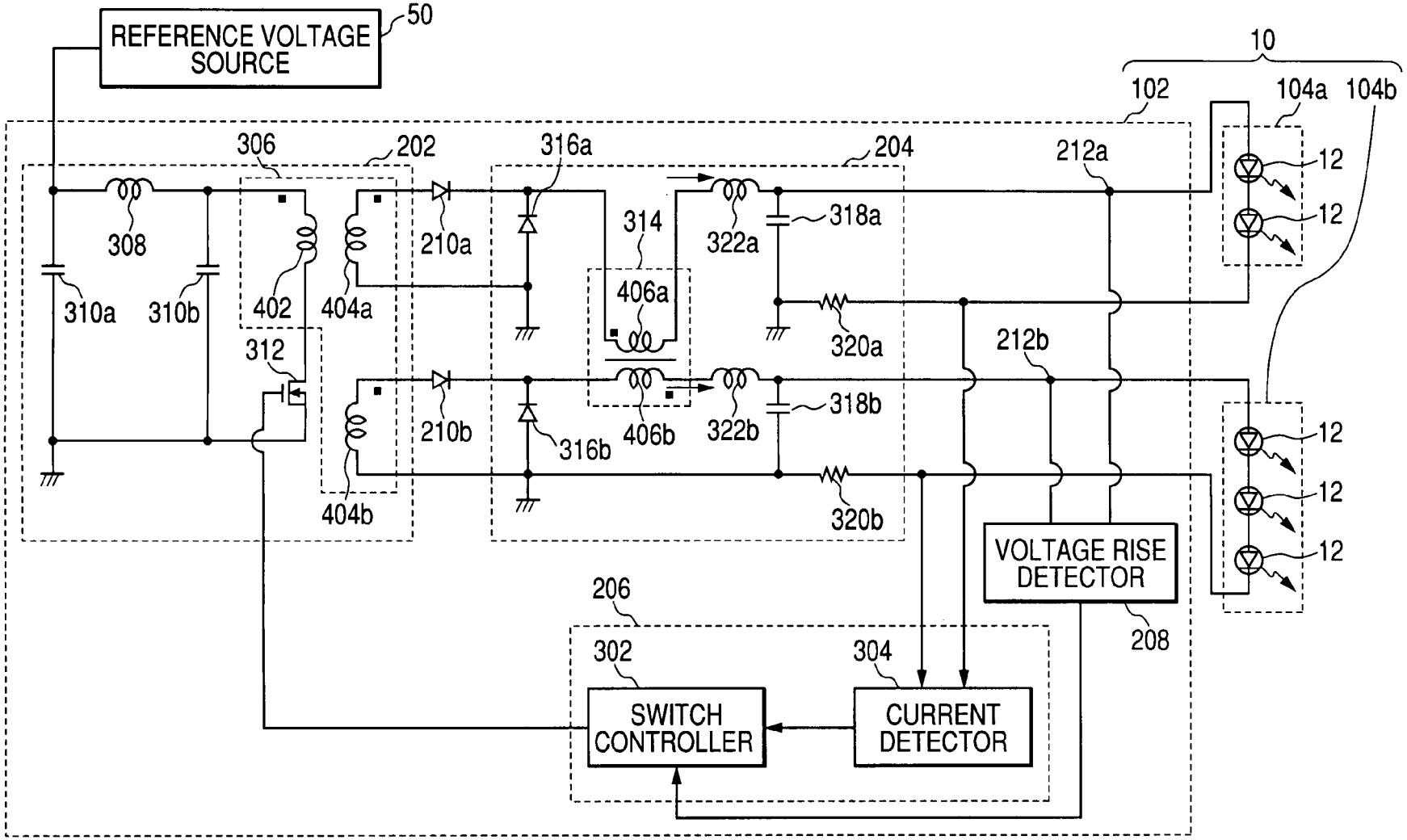
FIG. 1 is a diagram showing the structure of a vehicle lamp, together with a reference voltage source, according to one embodiment of the present invention.

FIG. 1 is a diagram showing the configuration, according to one embodiment of the present invention, of a vehicle lamp 10 and a reference voltage power source 50. The reference power source 50, for example, is a vehicular-mounted battery that supplies a predetermined direct-current voltage to a power supply device 102. In this embodiment, the vehicle lamp 10 includes a plurality of light sources 104*a* and 104*b* and the power supply device 102. The embodiment provides a power supply device 102 that can supply a current, at a desired ratio, to the light sources 104*a* and 104*b*.

The light sources 104*a* and 104*b* are example loads, connected to the power supply device 102, that are connected in parallel and include one or more light-emitting diode devices 12. In one embodiment of the invention, the light-emitting diode devices 12 are example semiconductor light-emitting devices that generate light in accordance with power received from the power supply device 102.

The light sources 104*a* and 104*b* may have a different number of light-emitting diode devices 12, and may have a plurality of light source arrays connected in series. The light source arrays are, for example, one or more serially connected arrays of the light-emitting diode devices 12.

The power supply device 102 includes: a voltage output unit 202; a plurality of output current supply units 210*a* and 210*b*; a current ratio setup unit 204; a voltage rise detector 208; and an output controller 206. The voltage output unit 202 includes: a coil 308; a plurality of capacitors 310*a* and 310*b*; a switching device 312; and a power supply transformer 306.

The coil 308, connected in series to a primary coil 402 of the power supply transformer 306, supplies the output voltage of the reference voltage power source 50 to the power supply transformer 306. The capacitors 310*a* and 310*b* smooth voltages at both ends of the coil 308. The switching device 312, which is an example primary switch for one embodiment of the invention, is connected in series to the primary coil 402 of the power supply transformer 306, such that rendering the output of the switching device 312 on or off by the output controller 206 selects whether or not a current is supplied to the power supply transformer 306.

The power supply transformer 306, which is an example regulator transformer for one embodiment of the invention, includes the primary coil 402 and a plurality of secondary coils 404*a* and 404*b*. When the switching device 312 is rendered on, the primary coil 402 transmits, via the coil 308, a current received from the reference voltage power source 50. The secondary coils 404*a* and 404*b* that are provided correspond to the light sources 104*a* and 104*b*, and transmit to the corresponding light sources 104*a* and 104*b*, via the output current supply unit 210 and the current ratio setup unit 204, a voltage or a current that are consonant with the current that flows across the primary coil 402 and the voltage applied at both ends of the primary coil 402. As a result, the voltage output unit 202 supplies the voltage and the current to the light sources 104*a* and 104*b*. It should be noted that the secondary coils 404*a* and 404*b* may have the same number of turns, but consonant with the number of turns, may output different voltages.

The current output supply units 210*a* and 210*b* are diodes provided in consonance with the secondary coils 404*a* and 404*b*, and are connected in the forward direction between the secondary coils 404*a* and 404*b*. With this structure, the output current supply unit 210*a* and 210*b* can supply to the light source 104*a* and 104*b*, via the current ratio setup unit 204, voltages and currents output by the corresponding secondary coils 404*a* and 404*b*.

The current ratio setup unit 204 includes: a plurality of capacitors 310*a* and 310*b*; a plurality of series resistances 320*a* and 320*b*; an output transformer 314; a plurality of inductance current leakage supply units 316*a* and 316*b*; and a plurality of coils 322*a* and 322*b*. The capacitors 318*a* and 318*b* and the series resistors 320*a* and 320*b* are provided, in correspondence with the light sources 104*a* and 104*b*, and the capacitors 318*a* and 318*b* smooth a current flowing across the corresponding light sources 104*a* and 104*b*. The series resistors 320*a* and 320*b* are serially connected to the corresponding light sources 104*a* and 104*b*, and at both ends, generate voltages in consonance with a current flowing through the corresponding light sources 104*a* and 104*b*.

The output transformer 314, which is an example coupling transformer for one embodiment of the invention, includes a plurality of output coils 406*a* and 406*b*. The output coils 406*a* and 406*b* are provided in correspondence with the light sources 104*a* and 104*b*; and the output coil 406*a* is connected via the coil 322*a* to the corresponding light source 104*a*, while the output coil 406*b* is connected via the coil 322*b* to the corresponding light source 104*b*. The output coils 406*a* and 406*b* transmit, to the corresponding light sources 104*a* and 104*b*, a current supplied by the voltage output unit 202. It should be noted that the light emitting diodes 12 in the light source 104*a* or 104*b* are connected in series to the corresponding coil 406*a* or 406*b* via the coil 322*a* or 322.

In this embodiment, the output coils 406*a* and 406*b* are wound in opposite directions. Therefore, in accordance with the current supplied to the light sources 104*a* and 104*b* by the voltage output unit 202, the output coils 406*a* and 406*b* generate magnetic fluxes in a direction in which they cancel each other. Further, since the output coils 406*a* and 406*b* in a transformer are coupled, the ratio at which a current flows through the output coil 406*a* and the output coil 406*b* is the opposite of that of the turn ratio. Thus, the coils 322*a* and 322*b* may represent a flux leakage by the output transformer 314. In this case, the inductances of coils 322*a* and 322*b* are proportional to the squares of the turn ratios of the corresponding output coils 406*a* and 406*b*.

The leakage inductance current supply units 316*a* and 316*b* are diodes provided in correspondence with the output coils 406*a* and 406*b*. The leakage inductance current supply units 316*a* and 316*b* are connected in opposite directions between the cathodes of diodes that constitute the output current supply units 210*a* and 210*b* and the low potential output terminals of the secondary coils 404*a* and 404*b* to which the anodes of these diodes are connected. In this case, the inductance current leakage supply units 316*a* and 316*b* discharge to the capacitors 318*a* and 318*b*, via the corresponding output coils 406*a* and 406*b*, energy accumulated by the corresponding coils 322*a* and 322*b*. Thus, when currents supplied by the voltage output units 202*a* and 202*b* to the light source units 104*a* and 104*b* are reduced, the inductance current leakage supply units 316*a* and 316*b* supply to the light sources 104*a* and 104*b* currents in amounts consonant with the corresponding coils 322.

In one embodiment, the inductance current leakage supply units 316*a* and 316*b* constitute a forward converter, in addition to the power supply transformers 306*a* and 306*b*, the switching device 312, the output current supply units 210*a* and 210*b*, the output coils 406*a* and 406*b* and the coils 322*a* and 322*b*. During the period the switching device 312 is OFF, the inductance current leakage supply units 316*a* and 316*b* discharge, to the capacitors 318*a* and 318*b*, energy accumulated by the coils 322*a* and 322*b* during the period of the switching device 312 was ON.

When, for example, the inductance current leakage supply units 316*a* and 316*b* are not employed, energy accumulated by the coils 322*a* and 322*b* would be a loss during the period the switching device 312 is OFF. However, according to this embodiment, the energy accumulated by the coils 322*a* and 322*b* can be efficiently provided for the light sources 104*a* and 104*b*.

The voltage rise detector 208 detects the elevation of a voltage applied to each of the light sources 104*a* and 104*b*. This a voltage supplied to a node a and a node b, which are located between the light sources 104*a* and 104*b* and the corresponding coils 322*a* and 322*b*, and is, for example, an absolute value for a difference between the potentials of the nodes 212 and a ground potential. The voltage rise detector 208 detects, relative to the light sources 104*a* and 104*b*, that the voltages at the nodes 212 exceed a predesignated value. Or, the voltage rise detector 208 may detect an elevation of the absolute values of the potentials at the nodes 212.

The output controller 206, which is an example control circuit of one embodiment of the invention, includes a current detector 304 and a switch controller 302. The current detector 304 detects voltages at both ends of each of the series resistors 320*a* and 320*b*, and detects currents flowing through the light source 104*a* or 104*b* that correspond to the series resistor 320*a* or 320*b*. The switch controller 302 performs, for example, the well known PWM control or PFM control in accordance with the current detected by the current detector 304, and controls the ON or OFF time of the switching device 312. In this manner, the switch controller 302 controls the switching device 312, so that a constant current value is detected by the current detector 304. In one embodiment, the values of the currents flowing through both the light sources 104*a* and 104*b* are detected; however, since the current ratios are designated in advance by the output transformer 314, only the current flowing through one of the light sources 104 may be detected.

When the voltage rise detector 208 detects at the nodes 212*a* and 212*b* the elevation of the voltage for either light source 104*a* or 104*b*, the switch controller 302 maintains the OFF condition of the switching device 320 and halts the output of the voltage by the voltage output unit 202. Thus, the output controller 206 provides a failsafe function for halting the power supply device 102 upon the occurrence of an abnormality, and provides improved safety for the power supply device 102.

In another example, the switch controller 302 may selectively halt the output by the voltage output unit 202 of the voltage to the light source 104, for which the voltage elevation at the node 212 is detected. In this case, a light source unaffected by the abnormality can be continuously on. As a result, a vehicle lamp 10 can be provided that has a high redundancy relative to failures.

Because, for example, of the light distribution design of the vehicle lamp 10, light sources 104*a* and 104*b*, for which required voltage values and current values differ, may be employed. In this case, when a power supply device 102 is provided for each of the light sources 104, costs would be increased. However, according to embodiments of the invention, in the single power supply device 102, the secondary coils 404*a* and 404*b* are individually provided for the light sources 104*a* and 104*b*, so that an appropriate voltage can be applied for each of the individual light sources 104*a* and 104*b*. Further, since the output transformer 314 is employed for which the output coils 406*a* and 406*b* are provided, an appropriate current ratio can be designated for the supply of a current to the light sources 104*a* and 104*b*. Thus, according to embodiments of the invention, the cost of properly turning on the light sources 104*a* and 104*b* can be low, and a vehicle lamp 10 can be provided at a low cost.

As another example, the output coils 406*a* and 406*b* of the output transformer 314 may be wound in the same direction. In this case, the output coils 406*a* and 406*b* both generate magnetic fluxes in a direction in which each magnetic flux is increased by the other, and accordingly, voltages are generated at their ends in consonance with the ratio of the number of turns. Therefore, in this case, it is preferable that the number of turns for the coils 406*a* and 406*b* be consonant with the voltages to be applied to their corresponding light sources 104*a* and 104*b*.

Figure 2A:
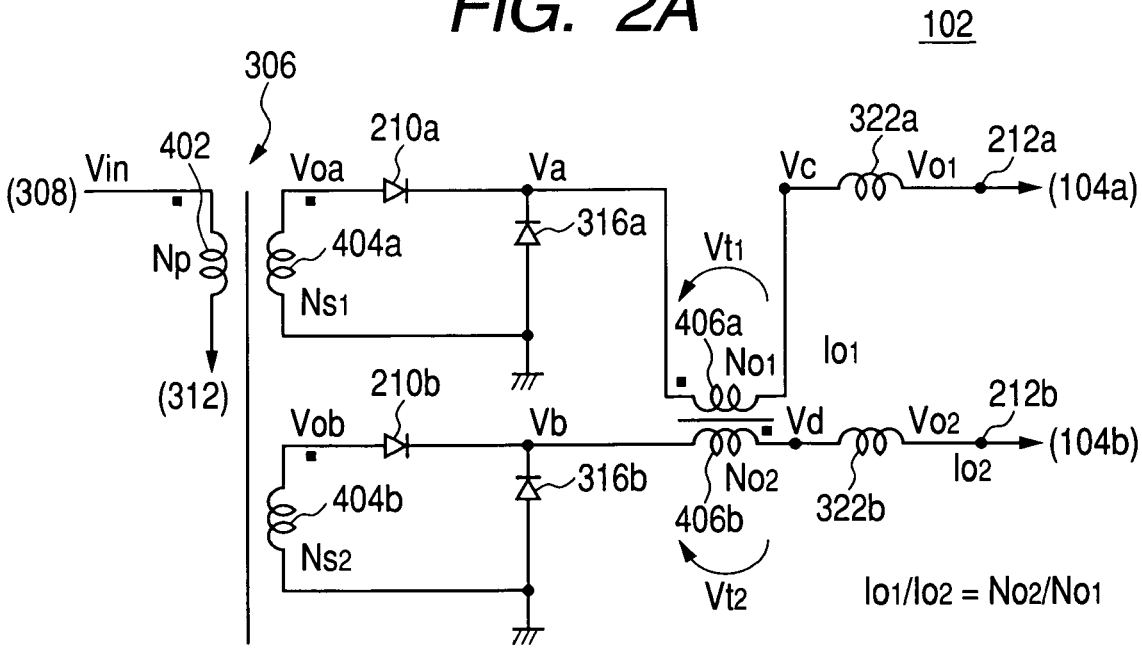
FIGS. 2A and 2B are diagrams for explaining one example operation for a power supply device.
Figure 2B:
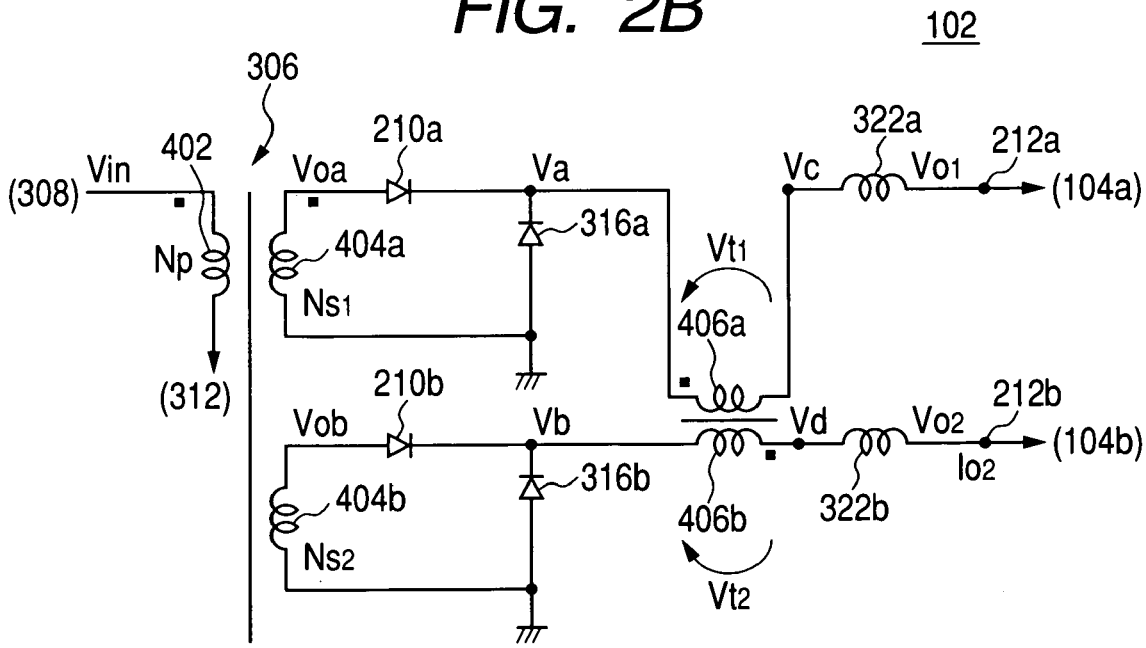

FIGS. 2A and 2B are diagrams for explaining an example operation performed by the power supply device 102. In FIGS. 2A and 2B, only portions required for the explanation are extracted from the power supply device 102. In FIG. 2A, the power supply device 102 shown is one for which normal light sources 104*a* and 104*b* are provided. In FIG. 2B, the power supply device 102 shown is one when only the light source 104*a* is open. The open state represents a condition wherein the section between the node 212 and the ground potential terminal is in a high impedance state, resulting, for example, from the disconnection of the light source 104.

In one embodiment, the number of turns for the primary coil 402 is $N_p$, the number of turns for both the secondary coils 404*a* and 404*b* are $N_{s1}$ and $N_{s2}$, and the number of turns for both the output coils 406*a* and 406*b* are $N_{o1}$ and $N_{o2}$. The secondary coils 404*a* and 404*b* are connected in series to the corresponding light sources 104*a* and 104*b* and the output coils 406*a* and 406*b* and the coils 322*a* and 322*b*, which correspond to the light sources 104*a* and 104*b*.

The primary coil 402 receives a predetermined supply voltage $V_{in}$ from the reference voltage power source (see FIG. 1) via the coil 308. In this case, the secondary coil 404*a* outputs a terminal voltage $V_a$, denoting $V_{oa}=V_{in}\cdot N_{s1}/N_p$, while the secondary coil 404*b* outputs a terminal voltage $V_b$, denoting $V_{ob}=V_{in}\cdot N_{s2}/N_p$.

As is shown in FIG. 2A, when the light sources 104*a* and 104*b* are normal, the output coils 406*a* and 406*b* transmit currents $I_{o1}$ and $I_{o2}$, for which $I_{o1}/I_{o2}=N_{o2}/N_{o1}$ is established.

Thus, the current ratio setup unit 204 (see FIG. 1) designates a ratio for the currents flowing through the light sources 104*a* and 104*b*.

Then, voltages $V_{o1}$ and $V_{o2}$ are applied at the nodes 212*a* and 212*b*, wherein $V_{o1}=V_a-V_{t1}-V_{L1}$ and $V_{o2}=V_b-V_{t2}-V_{L2}$. $V_{t1}$ denotes a voltage generated at the output coil 406*a*; $V_{t2}$ denotes a voltage generated at the output coil 406*b*; $V_{L1}$ denotes a voltage generated at the coil 322*a* and represents the magnetic flux leakage at the output coil 406*a*; and $V_{L2}$ denotes a voltage generated at the coil 322*b* and represents the magnetic flux leakage at the output coil 406*b*.

Since the output coils 406*a* and 406*b* are wound in a direction that permits the magnetic fluxes to cancel each other, the inductances at the output coils 406*a* and 406*b* are nearly zero. Further, the output coils 406*a* and 406*b* may be wound near each other, like sandwiches, to reduce the magnetic flux leakage, and special coils 322*a* and 322*b* may be separately provided for the magnetic flux leakages. Either this, or the size of the windings of the output coils 406*a* and 406*b* may be intentionally enlarged to increase the magnetic flux leakage, and magnetic flux leakages 322*a* and 322*b* may result. Thus, the inductances $L_1$ and $L_2$ of the coils 322*a* and 322*b*, which represent the magnetic flux leakages, limit the currents and determine the inclinations of the rise and the fall of the current. Therefore, when the light sources 104*a* and 104*b* are normal, the only inductance elements present between the power supply transformer 306 and the light sources 104 are $L_1$ and $L_2$.

When only the light source 104*a* is open, as is shown in FIG. 2B, the terminal voltages $V_a$ and $V_b$ of the secondary coils 404*a* and 404*b* are unchanged because these voltages are determined in accordance with $V_{in}$ and the turn ratio of the power supply transformer 306. However, the output coil 406*a*, which corresponds to the light source 104*a*, accumulates energy in consonance with a current that flows across the output coil 406*b*. At this time, a voltage $V_{t1}$, for which $V_{t1}=V_{t2}\cdot N_{o1}/N_{o2}$ is established, is applied at both ends of the output coil 406*a*. Further, since the light source 104*a* is open, no current flows through the coil 322*a* and $V_{L1}$ is zero. As a result, the output coil 406*a* outputs to the node 212*a* a voltage $V_{o1}$ for which $V_{o1}=V_a+V_{t1}=V_a+V_{t2}\cdot N_{o1}/N_{o2}$ is established. Therefore, the voltage at the node 212*a*, which corresponds to the light source 104*a* in the open state, is increased, compared with when the light source 104*a* is normal. Further, the inductance element for the light source 104*b* is the sum of those for the output coil 406*b* and the coil 322*b* ($L_2$), and is larger than the inductance element in the normal state.

Since the terminal voltages $V_a$ and $V_b$ for the secondary coils 404*a* and 404*b* are unchanged when the light source 104*a* is open, to provide notification, by detecting these terminal voltages, that the open state exists is difficult. However, in this embodiment, since the voltage rise detector 208 (see FIG. 1) detects an increase in the voltage $V_{o1}$ or $V_{o2}$ at the node 212*a* or 212*b*, and the switch controller 302 (see FIG. 1) halts the power supply device 102, the open state of the light source 104 can be appropriately detected. Further, with this arrangement, the failsafe control for the open state of the light source 104, and/or the control of a multiple light source 104 redundancy, can be appropriately performed. That is, only the light source 104*b* can be turned on or off, and at this time, the switch controller functions as a simple one-output forward converter having a comparatively large inductance element.

Figure 3:
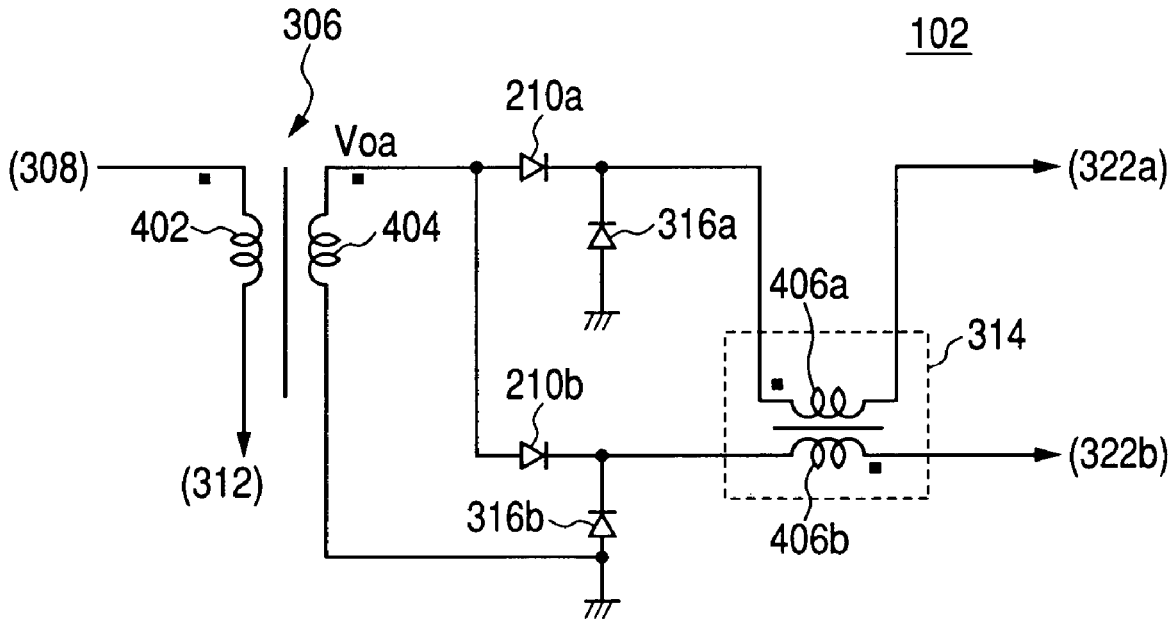
FIG. 3 is a diagram showing another example for a power supply transformer.

FIG. 3 is a diagram showing another example for the power supply transformer 306. Since the components denoted in FIG. 3 by the same reference numerals as those used in FIG. 1 have the same or corresponding functions, no further explanation for them will be given. The power supply transformer 306 includes the primary coil 402 and the secondary coil 404. The secondary coil 404 generates a voltage in accordance with a current that flows via the primary coil 402 and the turn ratio, relative to the primary coil 402. One end of the secondary coil 404 is connected to the anodes of the output current supply units 210*a* and 210*b*; the other end is grounded.

In this example, a single power supply device 102 must be employed only to apply an appropriate voltage to the individual light sources 104. Further, since the power supply transformer 306 having one output coil 406 can be employed to supply a voltage to the light sources 104, the number of devices required can be reduced, compared with when the power supply transformer 306 has a plurality of secondary coils 404. Therefore, both the size and the cost of the power supply device 102 can be reduced.

Figure 4A:
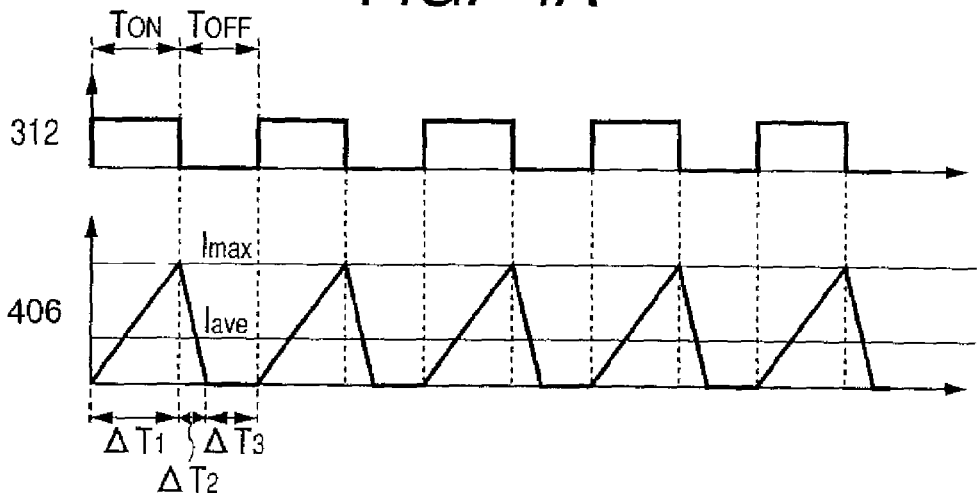
FIGS. 4A to 4C are diagrams for explaining example relationships between a gate voltage at a switching device and a current flowing through a output coil.
Figure 4B:
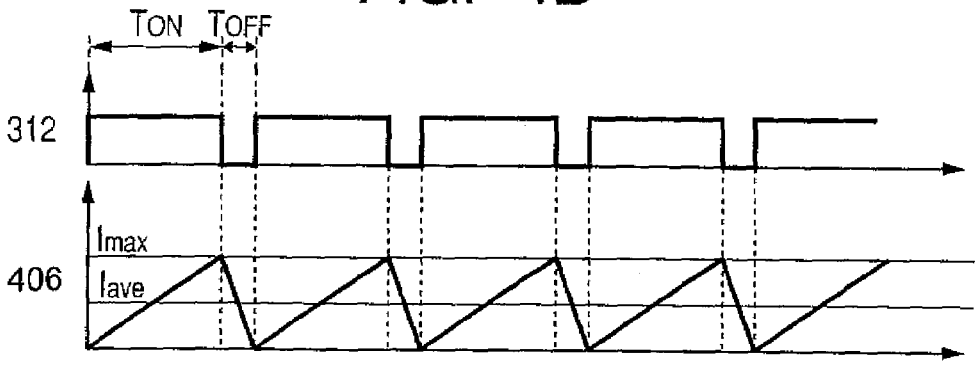
Figure 4C:
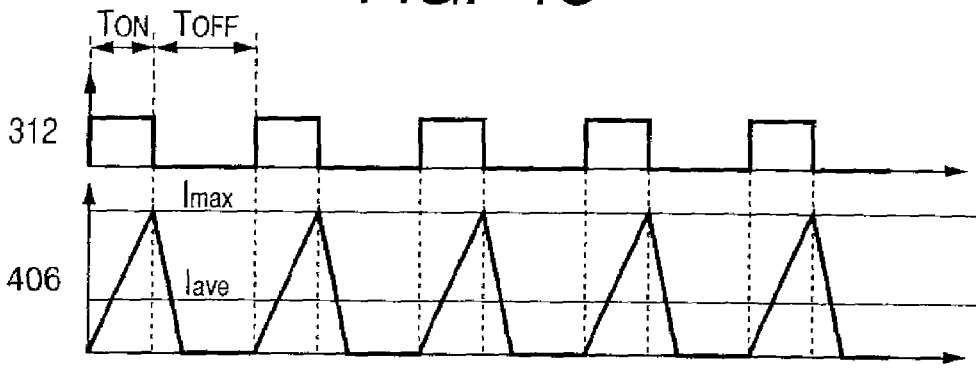

FIGS. 4A to 4C are diagrams for explaining a relationship between the gate voltage for the switching device and the current flowing through the output coil 406. In FIG. 4A is shown an example relationship between the gate voltage for the switching device 312 and the current transmitted via the output coil 406. In FIG. 4B is shown an example relationship between the gate voltage for the switching device 312 and the current transmitted via the secondary coil 404 when the voltage supplied to the power supply transformer 306 is lower than that in FIG. 4A. In FIG. 4C is shown an example relationship between the gate voltage for the switching device and the current across the output coil 406 when a voltage is to be supplied that is higher than that in FIG. 4A.

In one embodiment, during a predesignated period, the output controller 206 performs the well known PWM control, and applies a High voltage and a Low voltage to the gate terminal of the switching device 312. In FIGS. 4A to 4C, $T_{ON}$ represents a time in one period during which the switching device 312 receives at the gate terminal the High voltage output by the output controller 206; and $T_{OFF}$ represents a time in one period during which the switching device 312 receives a Low voltage from the output controller 206 at the gate terminal. The switching device 312 is turned on in the $T_{ON}$ period, and transmits a current to the primary coil 402, while the switching device 312 is turned off in the $T_{OFF}$ period, and halts the transmission of a current to the primary coil 402.

In the case shown in FIG. 4A, during the $T_{ON}$ period, the switching device 312 continues to supply a current to the primary coil 402, so that the current flowing through the secondary coil 404 is increased until the switching device 312 is turned off. During this period, the current is transmitted via the secondary coil 404, the output current supply unit 210, the output coil 406, the coil 322 and the capacitor 318. Further, since the rate at which to increase the current flowing through the output coil 406 depends on the supply voltage $V_{in}$, when the supply voltage $V_{in}$ is high, the current flowing across the output coil 406 is sharply increased and $\Delta T_1$ is shortened. Whereas when the supply voltage $V_i$ is low, the current flowing across output coil 406 is moderately increased, and $\Delta T_1$ is extended.

When the switching device 312 is turned off by the output controller 206, a current is supplied via the inductance current leakage supply unit 316, the output coil 406, the coil 311 and the capacitor 318, so that the strength of the current flowing through the output coil 406 is reduced. The rate at which to reduce the current in the output coil 406 does not depend on the supply voltage $V_{in}$, and is determined by a circuit constant. An average current $I_{ave}$ is supplied by the capacitor 318 to the light source 104 and the series resistor 320.

As is described above, during the $T_{ON}$ period, the output controller 206 supplies a current to the primary coil 402, and during the $T_{OFF}$ period, halts the current flowing through the primary coil 402, so as to supply, to the output coil 406, a current that is increased during a period $\Delta T_1$ or reduced during a period $\Delta T_2$. Furthermore, the output controller 206 controls the duty ratio of the pulse so that the $T_{OFF}$ period is longer than the $\Delta T_2$ period. Thus, the current flowing through the output coil 406 is adjusted to zero during a period represented by $\Delta T_3$. As is described above, under the control exercised by the switching controller 302, the switching device 312 is repetitively turned on or off, and the output coil 406 transmits a saw-wave shaped current, as is shown in FIG. 4A, that includes the period wherein no current was flowing. A current flowing through the output coil 406 is smoothed by the coil 322 and the capacitor 318, and the resultant current is supplied to the light source 104. When the maximum value of the current flowing through the output coil 406 is defined as $I_{max}$, and the average current smoothed and supplied to the light source 104 is $I_{ave}$, the output controller 206 controls the $T_{ON}$ time so that $I_{max}$ is greater than twice of $I_{ave}$.

The relationship between the voltages and the current at the individual sections will now be described in detail while referring to FIG. 2A. Assuming that $V_{aon}$, $V_{bon}$, $V_{con}$ and $V_{don}$ denote voltages of $V_a$, $V_b$, $V_c$, and $V_d$ when the switching device 312 is on, the following relation is established.

$$V_{aon}=V_{in}(N_{S1}/N_P)-V_f \quad \text{Ex. 1}$$

$$V_{bon}=V_{in}(N_{S2}/N_P)-V_f \quad \text{Ex. 2}$$

$$N_{o1}/N_{o2}=(V_{con}-V_{aon})/(V_{bon}-V_{don}) \quad \text{Ex. 3}$$

$$N_{o1}/N_{o2}=((V_{don}-V_{o2})/L_2)/((V_{con}-V_{o1})/L_1) \quad \text{Ex. 4}$$

Assuming that $V_i$, $V_{boff}$, $V_{coff}$ and $V_{doff}$ denote voltages of $V_a$, $V_b$, $V_c$ and $V_d$ when the switching device 312 is off, the following relation is established.

$$V_{aoff}=V_{boff}=-V_f \quad \text{Ex. 5}$$

$$N_{o1}/N_{o2}=(V_{aoff}-V_{coff})/(V_{doff}-V_{boff}) \quad \text{Ex. 6}$$

$$N_{o1}/N_{o2}=((V_{o2}-V_{doff})/L_2)/((V_{o1}-V_{coff})/L_1) \quad \text{Ex. 7}$$

In this case, $V_f$ denotes a voltage drop at the diode provided for the output current supply unit and the inductance current leakage supply unit.

Further, in expressions 1 to 4 and expressions 5 to 7, the ratio of $V_{aon}$ to $V_{bon}$ completely equals to the ratio of $V_{o1}$ to $V_{o2}$, the same amount of energy that the output coil 406*b* provided for the output coil 406*a* during the ON period for the switching device 312 was returned by the output coil 406*a* to the output coil 406*b* during the OFF period for the switching device 312. However, a wide discrepancy appears in the forward voltage for the individual light-emitting diode devices 12 included in the light sources 104 and the forward voltage for the light-emitting diode device 12 is changed in accordance with the temperature, and also, a variance appears in the voltage change for the individual light-emitting diode devices. Therefore, it is difficult for the ratio $V_{o1}$ to $V_{o2}$ to match the ratio $V_{aon}$ to $V_{bon}$. Therefore, when the ratio $V_{aon}$ to $V_{bon}$ differs from the ratio of $V_{o1}$ to $V_{o2}$, the amount of energy that differs from the amount of energy that the output coil 406*a* provided for the output coil 406*b* during the ON period of the switching device 312 is returned by the output coil 406*a* to the output coil 406*b* during the OFF period for the switching device 312. Accordingly, an energy deviation occurs between the output coils 406*a* and 406*b*, and the output transformer 314 is unevenly magnetized.

When the output transformer 314 is unevenly magnetized, a direct current would be retained in one of the output coils 406*a* or 406*b*. Then, the current consumed by the power supply device 102 would be increased, and the power supply device 102 would be damaged by the heat that it generates. Further, when uneven magnetization is accumulated, magnetic fluxes at the cores of the power supply transformer 306 and the output transformer 314 would be saturated, so that either the amount of current supplied to the light sources 104 is reduced or the light sources 104 are not appropriately turned on. Further, since the output controller 206 controls the switching device 312 to maintain a desired value for a current to be supplied to the light sources 104, the switching device 312 would be damaged by generated heat.

However, in one embodiment, for each switch process at the switching device 312, the output controller 206 extends the $T_{OFF}$ until it is longer than $\Delta T_2$, and reduces, to zero, the minimum value of the output current at the output coil 406. Thus, there is a moment whereat the amount of current present in the output transformer 314 is zero. Therefore, uneven magnetization does not occur on the output transformer 314, and a direct current is not retained in the output transformer 314. Thus, heat generation by the power supply device 102 can be prevented, and current can be supplied to multiple light sources 104 at a desired ratio. It should be noted, however, that the amount of energy exchanged by the output coils 406*a* and 406*b* should match, to the extent possible, to prevent uneven magnetization, and that the ratio $V_{aon}$ to $V_{bon}$ and the ratio $V_{o1}$ to $V_{o2}$ should be so designated that they are as equal as possible in order to reduce a loss due to uneven magnetization.

When $\Delta I_1$ and $\Delta I_2$ denote changes in the amount of the currents flowing through the output coils 406*a* and 406*b*, $L_1$ and $L_2$ denote inductances for the coils 322*a* and 322*b*, $T_{on}$ denotes the period wherein the switching device 312 is on, and $T_{off}$ denotes the period wherein the switching device 312 is off, the following relationship is established.

$$\Delta I_1=((V_{con}-V_{o1})/L_1)T_{on}=((V_{o1}-V_{coff})/L_1)T_{off} \quad \text{Ex. 8}$$

$$\Delta I_2=((V_{don}-V_{o2})/L_2)T_{on}=((V_{o2}-V_{doff})/L_2)T_{off} \quad \text{Ex. 9}$$

The output controller 206 controls the $T_{ON}$ period so that $I_{max}$, which is the maximum value of the current for the output coil 406, is twice as large as $I_{ave}$, which is the target value for a current to be supplied to the light sources 104. Through the provision of this control, when the minimum value of the current flowing through the output coil 406 is zero, the average value of the current supplied to the light sources 104 can easily be near the target value.

Furthermore, in one embodiment, when the voltage ($V_{in}$) supplied to the power supply transformer 306 is reduced, as is shown in FIG. 4B, the output controller 206 extends the $T_{ON}$ period and maintains a constant average current for supply to the light sources 104. Even in this case, the $T_{OFF}$ period is adjusted so it is longer than the period $\Delta T_2$, which is a period required for the reduction of the current flowing through the output coil 406. With this arrangement, the current can be supplied to the multiple light sources 104 at a desired ratio, and when the voltage ($V_{in}$) supplied to the power supply transformer 306 is reduced, the supply of a constant average current to the light sources 104 can be maintained.

In addition, in one embodiment, when the voltage ($V_{in}$) supplied to the power supply transformer 306 is increased, as is shown in FIG. 4C, the output controller 206 reduces the $T_{ON}$ period and maintains the constant average current that is to be supplied to the light sources 104. In this case, the $T_{OFF}$ period is much longer than the period $\Delta T_2$, and uneven magnetization at the output transformer 314 does not occur.

Therefore, a current can be supplied to the multiple light sources 104 at a desired ratio, and when the voltage ($V_{in}$) supplied to the power supply transformer 306 is changed, the supply to the light sources 104 of a constant average current can be maintained.

Figure 5A:
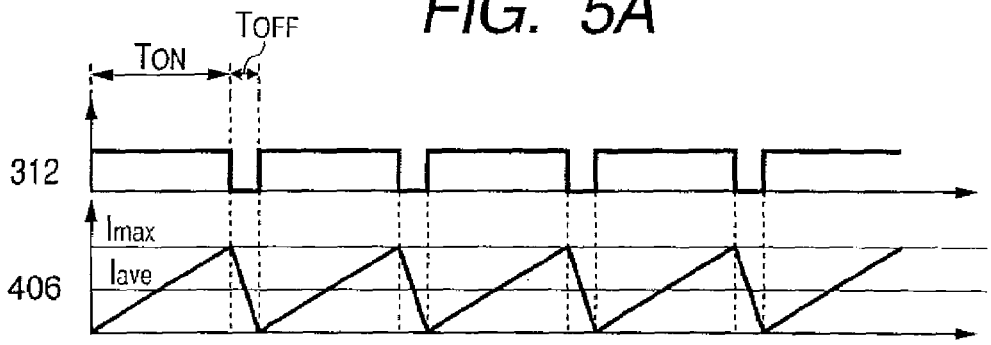
FIGS. 5A to 5C are diagrams for explaining example relationships between a gate voltage at the switching device and a current flowing through the output coil.
Figure 5B:
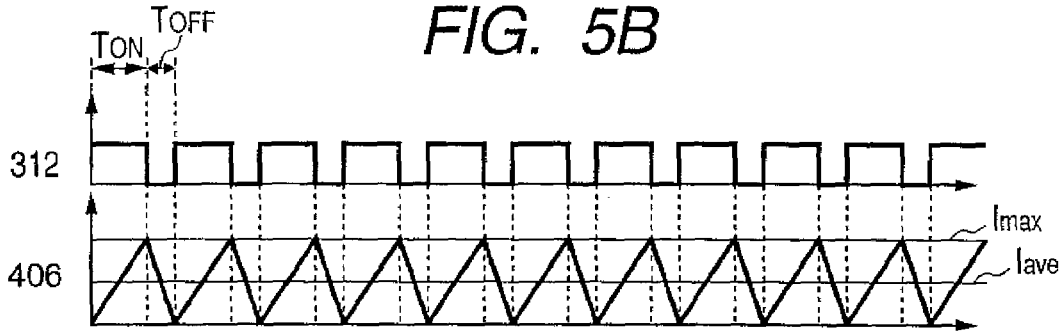
Figure 5C:
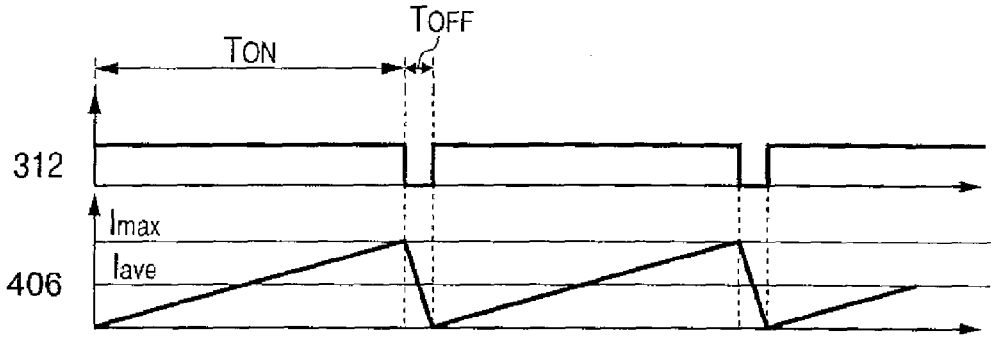

FIGS. 5A to 5C are diagrams for explaining another example OF the relationship between the gate voltage of the switching device 312 and the current in the output coil 406. In FIG. 5A is shown a relationship between the gate voltage at the switching device 312 and the current in the output coil 406. In FIG. 5B is shown a relationship between the gate voltage at the switching device and the current in the secondary coil 404 when the voltage supplied to the power supply transformer 306 is higher than in FIG. 5A. In FIG. 5C is shown a relationship between the gate voltage at the switching device 312 and the current in the output coil 406 when the voltage supplied is lower than in FIG. 5A.

In this example, the output controller 206 performs the well known PFM control during which the $T_{OFF}$ period for outputting a Low voltage is constant, and applies a High voltage and a Low voltage to the gate terminal of the switching device 312. In this example, regardless of the voltage supplied to the power supply transformer 306 and the current supplied to the light sources 104, the $T_{Off}$ period is designated substantially equal to the time $\Delta T_2$, during which the current reaches zero in the OFF time for the switching device 312. Therefore, as is shown in FIG. 5A, the time during which current flows through the output coil 406 is 0 is short. To obtain this setup, the $T_{OFF}$ time need only be determined based on the values of $V_{o1}$, $V_{o2}$, $L_1$ and $L_2$, i.e., based on expressions 8 and 9.

Assuming that the time at which the current flowing through the output coil 406 is zero is long, the maximum value $I_{max}$ of the current that flows through the output coil 406 during the ON period of the switching device 312 must be increased in order to supply a desired average current to the light sources 104. When the maximum value $I_{max}$ of the current flowing through the output coil 406 is large, the power conversion efficiency of the power supply transformer 306 would be reduced. However, in this example, since the output controller 206 transmits, to the gate signal of the switching device 312, a PFM signal that designates a reduction in the time whereat the current flowing through the output coil 406 is zero, deterioration of the power conversion efficiency of the power supply transformer 306 can be prevented. Accordingly, a rise in the temperature of the power supply device 102, and a reduction in the service life of the power supply device 102 can be suppressed, and the reliability of the power supply device 102 can be improved.

When the voltage supplied to the power supply device 102 is increased, and when the switching device 312 is turned on, the amount of current flowing through the output coil 406 is more sharply increased than in FIG. 5A. On the other hand, when the switching device 312 is turned off, the current flowing through the output coil 406 reaches zero at the time $\Delta T_2$, as in FIG. 5A. In this example, as is shown in FIG. 5*b*, when the voltage supplied to the power supply transformer 306 is raised, the output controller 206 maintains the length of the period $T_{OFF}$ so it is substantially equal to the period $\Delta T_2$, and increases the frequency at which the switching device 312 is to be turned on or off. Through this process, even when the voltage supplied to the power supply transformer 306 is raised, the supply of a constant amount of current to the light sources 104 can be maintained.

When the voltage supplied to the power supply transformer 306 is dropped, and when the switching device 312 is turned on, the current flowing through the output coil 406 is more moderately increased than in FIG. 5A. On the other hand, when the switching device 312 is turned off, the current flowing through the output coil 406 reaches zero at the time $\Delta T_2$, as in FIG. 5A. In this example, when the voltage supplied to the power supply transformer 306, shown in FIG. 5C, the output controller 206 maintains the length of the period $T_{OFF}$ so it is substantially equal to the period $\Delta T_2$, and reduces the switching frequency for the switching device 312 so as to maintain the supply of a constant current to the light sources 104. Through this process, the average current $I_{ave}$ supplied to the light sources 104 can be maintained, without changing the maximum value $I_{max}$ of the current that flows through the output coil 406 during the switching period for the switching device 312. As a result, power loss at the power supply transformer 306 can be minimized.

Figure 6A:
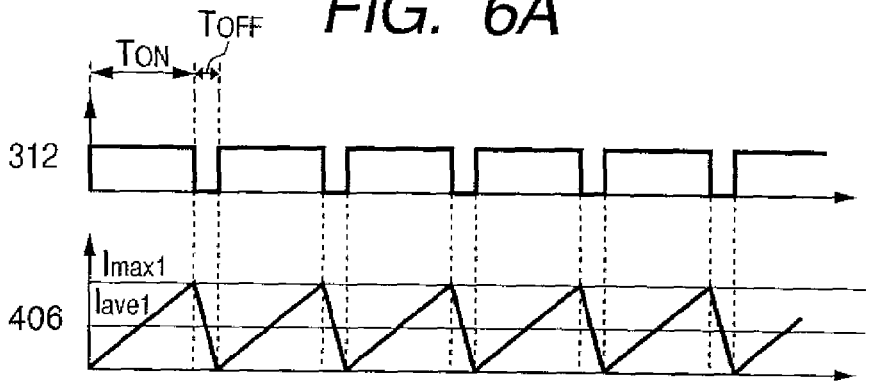
FIGS. 6A and 6B are diagrams for explaining example relationships between a gate voltage at the switching device and a current flowing through the output coil.
Figure 6B:
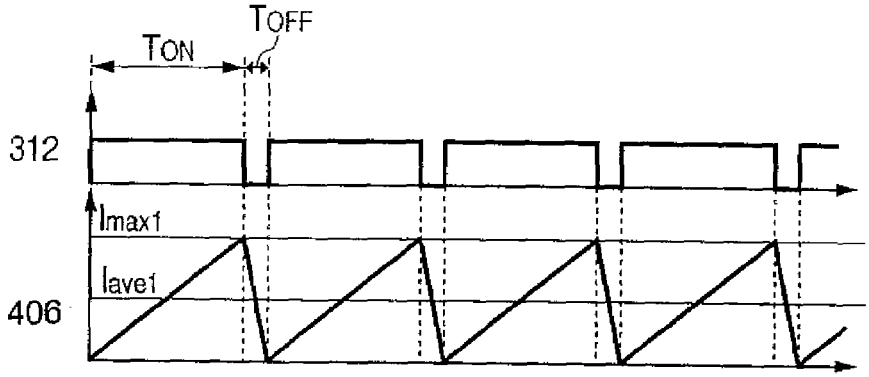

FIGS. 6A and 6B are diagrams for explaining an additional example for a relationship between the gate voltage at the switching device and the current flowing through the output coil 406. In FIG. 6A is shown the relationship between the gate voltage at the switching device 312 and the current flowing through the output coil 406. And in FIG. 6B is shown the relationship between the gate voltage at the switching device 312 and the current flowing through the output coil 406 when the average current to be supplied to the light sources 104 is raised more than in FIG. 6A.

In this example, the output controller 206 performs the well known PFM control wherein the period $T_{OFF}$ is constant, and applies a High voltage and a Low voltage to the gate terminal of the switching device 312. Furthermore, in this embodiment, regardless of the voltage supplied to the power supply transformer 306 and the current supplied to the light sources 104, the period $T_{OFF}$ is designated so it is substantially equal in the length of the period $\Delta T_2$. In this example, the voltage $V_{in}$ supplied to the power supply transformer 306 is substantially constant.

As is shown in FIG. 6B, when the target value of the current supplied to the light sources 104 is increased from $I_{ave1}$ to $I_{ave2}$, the output controller 206 maintains the length of the period $T_{OFF}$ so it is substantially equal to the period $\Delta T_2$, and reduces the switching frequency for the switching device 312, so that the average current supplied to the light sources 104 is increased. Through this process, the average value for the current flowing through the output coil 406 can be increased, without changing the rate for the increase in the current that flows through the output coil 406 at the switching time for the switching device 312. As is apparent from expressions 8 and 9, the period $T_{OFF}$ need only be extended by a value equivalent to an $I_{ave}$ increase, i.e., an increase of $\Delta I$.

Figure 7:
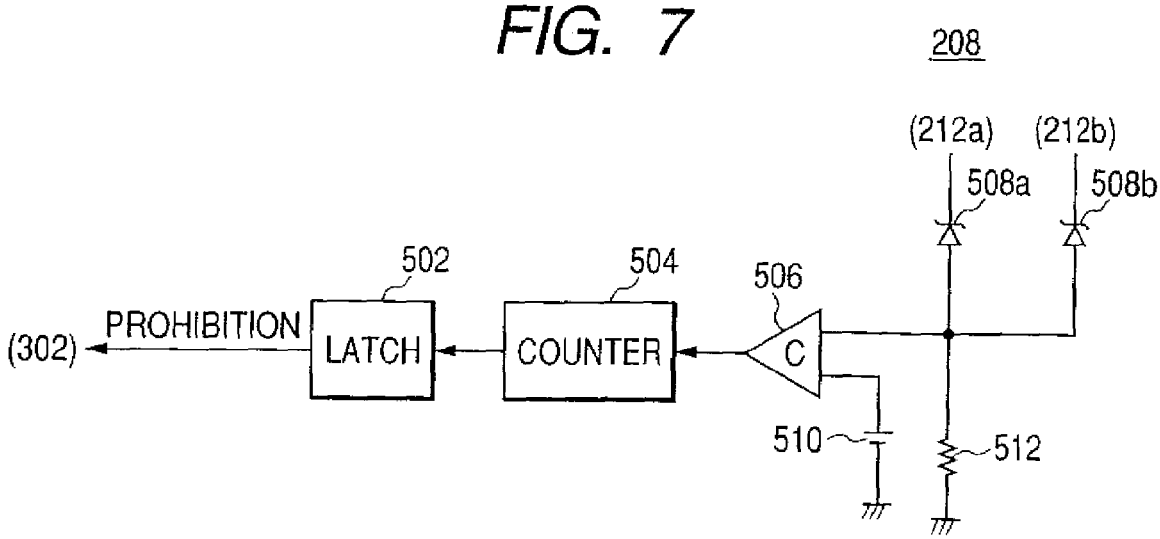
FIG. 7 is a diagram showing an example structure for a voltage rise detector.

FIG. 7 is a diagram showing an example structure for the voltage rise detector 208. In this example, the voltage rise detector 208 includes: a plurality of Zener diodes 508*a* and 508*b*, a comparator 506, a resistor 512, a constant voltage source 510, a counter 504 and a latch 502. The Zener diodes 508*a* and 508*b* provided correspond to the light sources 104*a* and 104*b* (see FIG. 1), and the cathodes of the Zener diodes 508*a* and 508*b* are connected to the corresponding light sources 104*a* and 104*b* while the anodes are connected to one of the input terminals of the comparator 506. The other input terminal of the comparator 506 is grounded through the resistor 512. And when the voltage of the corresponding node 212 is higher than the Zener voltage, the Zener diode 508 provides the voltage at the node 212 to the comparator 506.

At the input terminal, the comparator 506 receives a predetermined voltage via the constant voltage source 510. Since the constant voltage source 510 provides for the comparator 506*a* voltage lower than the Zener voltage at the Zener diode 508, the comparator 506 inverts the output when the voltage of either node 212 is higher than the Zener voltage at the Zener diode 508. Thus, an increase in the voltage at the node 212 that exceeds a predesignated value can be properly detected.

The counter 504 delays the output of the comparator 506, and supplies the output to the latch 502. The latch 502 latches the output of the counter 504, and transmits the obtained value to the switch controller 302. Thus, an abnormality, such as an open state of the light source 104, can be distinguished from a rise in the voltage due to a temporary voltage change caused by noise. Therefore, in this example, an increase in the voltage at the node 212 can be appropriately detected, and the open state of the light source 104, for example, can be properly detected.

In another example, the voltage rise detector 208 may include a plurality of resistors, instead of the multiple Zener diodes 508*a* and 508*b*. These resistors can be located between the node 212 and the comparator 506, instead of the Zener diodes 508. In this example, a rise in the voltage at the node 212 can also be appropriately detected.

Figure 8:
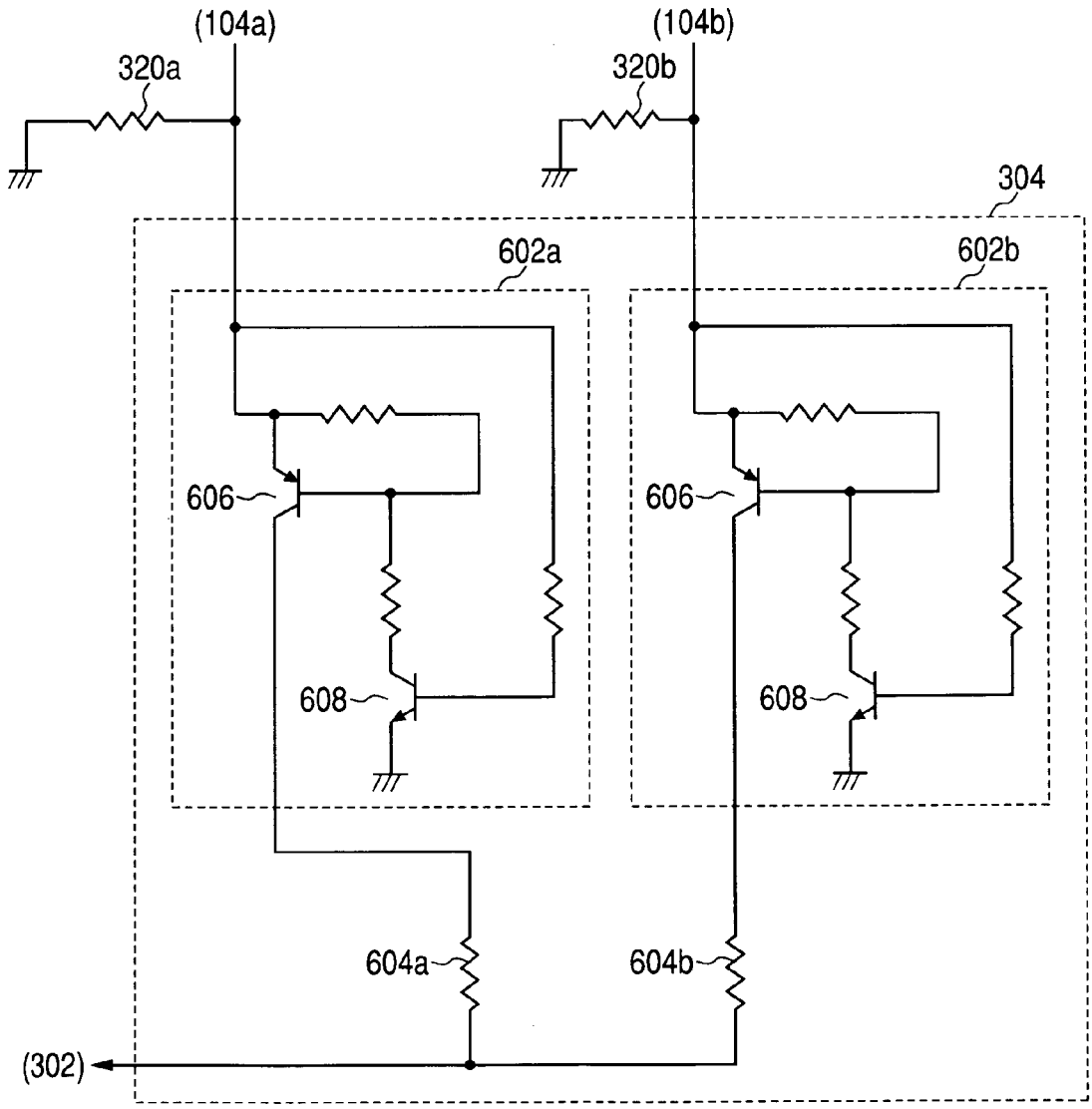
FIG. 8 is a diagram showing an example structure for a current detector, together with a plurality of series resistors.

FIG. 8 is a diagram showing an example structure of the current detector 304, as well as a plurality of series resistors 320*a* and 320*b*. In this example, the current detector 304 includes a plurality of disconnection detectors 602*a* and 602*b* and a plurality of resistors 604*a* and 604*b*, which correspond to the light sources 104*a* and 104*b*.

The disconnection detector 602 includes a PNP transistor 606, an NPN transistor 608 and a plurality of resistors. The base terminal of the PNP transistor 606 is connected to the emitter terminal via the resistor, and the emitter terminal is connected to a node located between the corresponding light source 104 and the series resistor 320. The collector terminal is connected to the corresponding resistor 604. The base terminal of the NPN transistor 608 is connected, via the resistor, to a node located between the corresponding light source 104 and the series resistor 320, and the collector terminal is connected, via the resistor, to the base terminal of the PNP transistor 606. The emitter terminal of the NPN transistor 608 is grounded. The resistor 604 connects the switch controller 302 and the collector terminal of the PNP transistor 606 of the corresponding disconnection detector 602, When a corresponding light source 104 is not open, the potential at the node located between this light source 104 and the series resistor 320 is a product of the value of the current that flows through the light source 104 and across the resistance of the series resistor 320. In this case, the NPN transistor 608 and the PNP transistor 606 are rendered on, and the resistor 604 receives, from the disconnection detector 602, the voltage generated at both ends of the series resistor 320.

Furthermore, when the corresponding light source 104 is open because of a disconnection, a current does not flow through the series resistor 320, so that the potential at the node between the light source 104 and the series resistor 320 is a ground potential. In this case, the NPN transistor 608 and the PNP transistor 606 are rendered off, and the resistor 604 receives a high impedance from the disconnection detector 602.

When the light sources 104*a* and 104*b* are not open, the current detector 304 supplies to the switch controller 302, as a detected current value, the average value of the voltages generated at both ends of each of the series resistors 320*a* and 320*b*. When either light source 104*a* or 104*b* is open, the current detector 304 supplies to the switch controller 302, as a detected current value, the average value of the voltages generated at both ends at the series resistors 320*a* and 320*b* that are not open. Then, the switching controller 302 controls the switching device 312 (see FIG. 1), so that the voltage received from the current detector 304 is constant.

The series resistors 320 are connected in series to the light sources 104 and the output coils 406 (see FIG. 1) corresponding to the light sources 104. Therefore, when the corresponding light sources 104 are not open, a current flows across the series resistors 320*a* and 320*b* at a current ratio that is designated by the output coils 406*a* and 406*b*.

In this example, the series resistors 320 have resistances for which the ratio is the opposite of the ratio for the current flowing through the corresponding light sources 104. Therefore, in this example, the series resistors 320 generate substantially equal voltages in accordance with the currents flowing through the corresponding light sources 104. Therefore, according to this example, when the average value of the voltages generated at the ends of the individual series resistors are adjusted so they equal the setup voltage defined in common for a plurality of series resistors 320, the current flowing through the light sources 104*a* and 104*b* can be appropriately controlled. The output controller 206 (see FIG. 1) need only control the voltage output by the voltage output unit 202, for the voltages generated at the ends of the individual series resistors 320 to equal the setup voltage.

The vehicle lamp 10 (see FIG. 1) may have three or more light sources 104, and when one of the light sources 104 is open, the current detector 304 may supply to the switch controller 302 the average value of the voltages generated at the ends of the series resistors 320 that are not open. In another example, the current detector 304 may supply to the switch controller 302 the sum of the voltages generated at the ends of the individual series resistors 320.

In an additional example, a plurality of light sources 104 may be turned on by controlling a voltage to be applied to these light sources. However, in this case, the control process would be complicated because of a variance in the forward voltage of the light-emitting diode devices 12 (see FIG. 1). However, according to the embodiment, since a current flowing through the individual light sources 104 is controlled, the multiple light sources 104 can be appropriately turned on.

Figure 9:
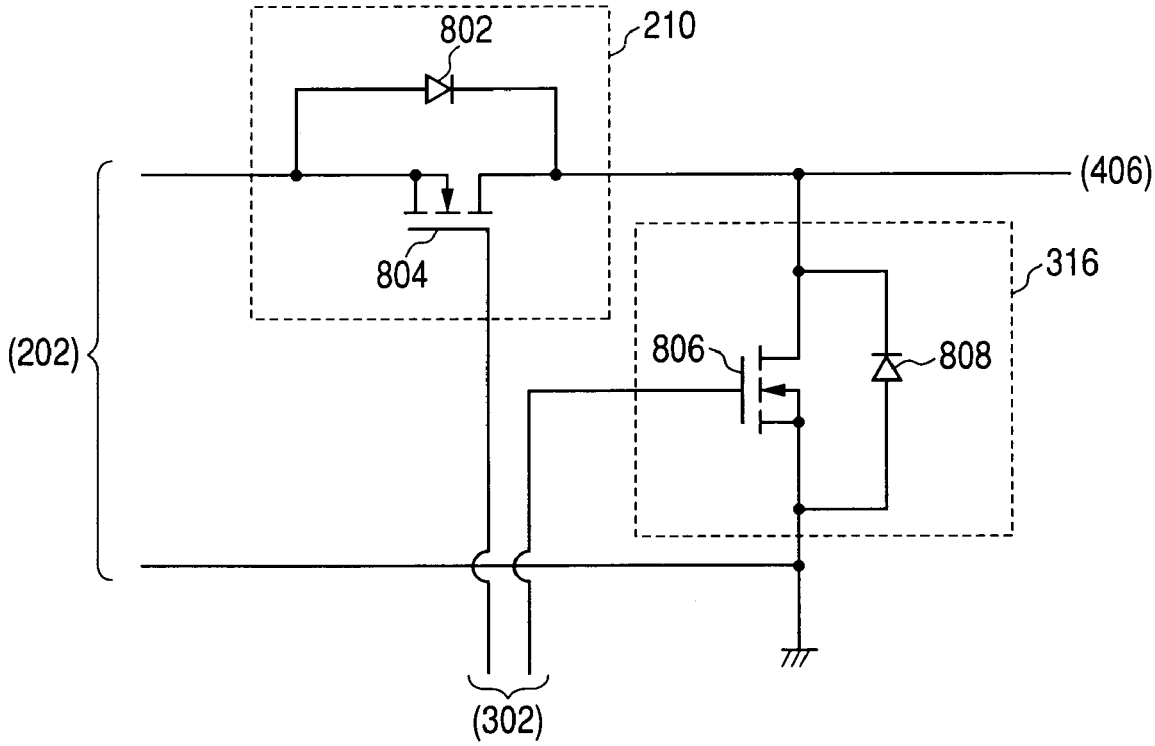
FIG. 9 is a diagram showing another example for the structures of an output current supply unit and an inductance current leakage supply unit.

FIG. 9 is a diagram showing another example structure for the output current supply unit 210 and the inductance current supply unit 316. In this example, the output current supply unit 210 includes a diode 802 and an NMOS transistor 804, and the leakage inductance current supply unit 316 includes a diode 808 and an NMOS transistor 806.

The diodes 802 and 808 have the same functions as the output current supply unit 210 and the inductance current leakage supply unit 316 in FIG. 1. The NMOS transistor 804 and the NMOS transistor 806 are rendered on or off, by the switching controller 302, in synchronization with the switching device 312 (see FIG. 1). In this example, during a period wherein the switching device 312 is on, the NMOS transistor 804 is rendered on, and with the diode 802, supplies a current to the output coil 406. During the period wherein the switching device 312 is off, the NMOS transistor 806 is rendered off, and with the diode 808, supplies a current to the output coil 406. In this manner, the NMOS transistors 804 and 806 perform synchronous rectification with the diodes 802 and 808. As a result, compared with rectification that uses only the diodes 802 and 804, the power loss can be reduced. The diodes 802 and 804 may be parasitic diodes for NMOS transistors.

Figure 10:
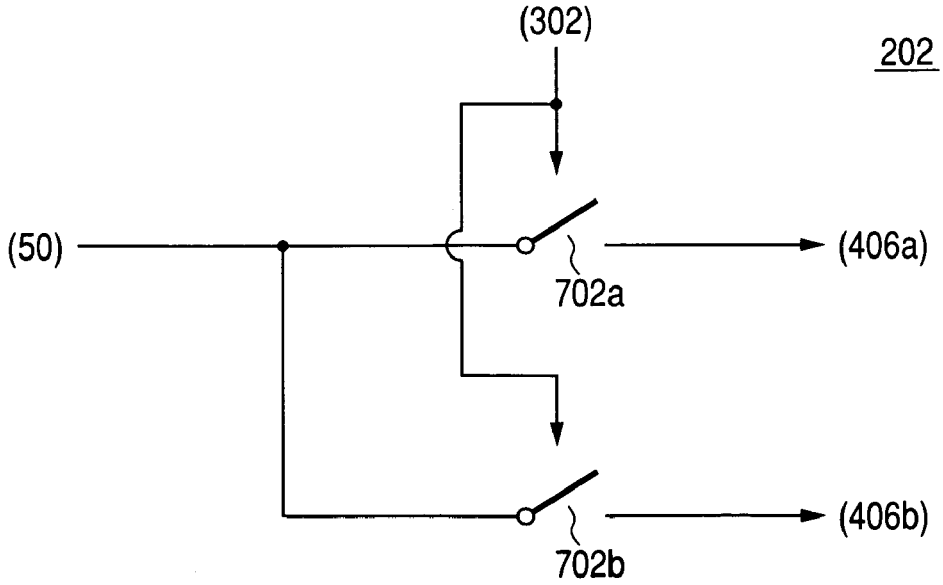
FIG. 10 is a diagram showing another example for the structure of a voltage output unit.

FIG. 10 is a diagram showing an additional example for the structure of the voltage output unit 202. In this example, the voltage output unit 202 includes a plurality of switches 702*a* and 702*b*, provided in correspondence with the light sources 104*a* and 104*b* (see FIG. 1). The switches 702 are used to connect the corresponding coils 406 for the reference voltage power source 50 in accordance with an instruction issued by the switch controller 302. In this case, the switch controller 302 turns on or off the switches 702*a* and 702*b* synchronously and simultaneously. The output coils receive, from the corresponding switches 702, rectangular waves consonant with the control by the switch controller 302. In this example, the ratio of the currents flowing through the output coils 406*a* and 406*b* can also be appropriately designated by using the output coils.

Figure 11:
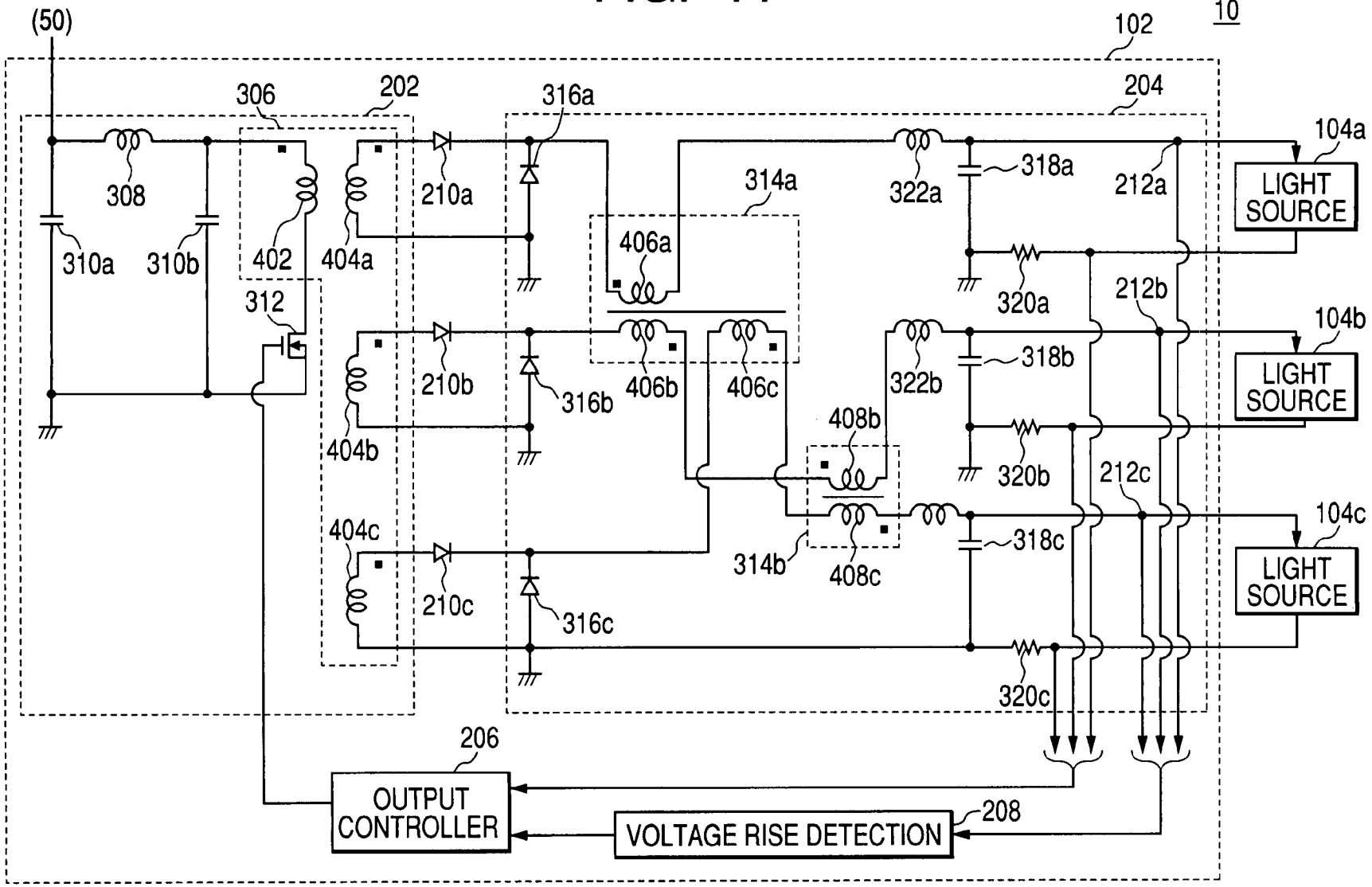
FIG. 11 is a diagram showing another example for the structure of the vehicle lamp.

FIG. 11 is a diagram showing an additional example for the structure of the vehicle lamp 10. Since the components in FIG. 11 denoted by the same reference numerals as used in FIG. 1 have the same or corresponding functions, no further explanation for them will be given, except for the following components. The vehicle lamp 10 includes a plurality of light sources 104*a* to 104*c*. Corresponding to the light sources 104*a* to 104*c*, the power supply transformer 306 includes a plurality of secondary coils 404*a* to 404*c*, a plurality of output current supply units 210*a* to 210*c*, a plurality of leakage inductance current supply units 316*a* to 316*c*, a plurality of capacitors 318*a* to 318*c* and a plurality of series resistors 320*a* to 320*c*. In this example, the voltage rise detector 208 detects not only voltages at nodes 212*a* and 212*b*, but also a voltage at a node 212*c* located between the light source 104*c* and a coil 322*c* corresponding to the light source 104*c*.

The current ratio setup unit 204 includes output transformers 314*a* and 314*b*, the number of which is smaller by one than the number of light sources 104. The output transformer 314*a* includes a plurality of output coils 406*a*, 406*b* and 406*c*, and the output transformer 314*b* includes a plurality of output coils 408*b* and 408*c*. The output coil 406*a* that is provided, and which corresponds to the light source 104*a*, is connected in series to the light source 104*a* via the coil 322*a*. The output coils 406*b* and the output coil 408*b* that are provided, and which correspond to the light source 104*b*, and are connected in series to the light source 104*b* through the coil 322*b*. And the output coil 406*c* and the output coil 408*c* that are provided, and which correspond to the light source 104*c*, are connected in series to the light source 104*c* through the coil 322*c*.

The output transformer 314*a* and 314*b* will now be described in more detail. In the output transformer 314*a*, the output coils 406*b* and 406*c* are wound in the same direction, in the opposite direction to the output coil 406*a*. Therefore, in accordance with a current that the voltage output unit 202 supplies to the corresponding light sources 104, the output coil 406*a* and the output coils 406*b* and 406*c* generate magnetic fluxes in a direction in which the magnetic fluxes cancel each other. In this case, the output coil 406*a* determines the ratio of the current flowing through the light source 104*a* to the current flowing through the light sources 104*b* and 104*c*. Furthermore, the output transformer 314*a* determines the rate, of the total current output by the power supply transformer 306, of the current to be supplied to the light source 104*a*.

When the numbers of turns of the output coils 406*a*, 406*b* and 406*c* are defined as $N_{o1}$, $N_{o2}$ and $N_{o3}$, and when the currents flowing through the light sources 104*a*, 104*b* and 104*c* are defined as $I_{o1}$, $I_{o2}$ and $I_{o3}$, the relation $I_{o1}=(N_{o2}\cdot I_{o2}+N_{o3}\cdot I_{o3})/N_{o1}$ is established. The ratio of $I_{o2}$ to $I_{o3}$ is determined by the output transformer 314*b*.

In the output transformer 314*b*, the output coil 408*b* and the output coil 408*c* are wound in opposite directions. Therefore, in the current that the voltage output unit 202 supplies to the corresponding light sources 104, the output coils 408*b* and the output coils 408*c* generate magnetic fluxes in directions in which the magnetic fluxes cancel each other. Thus, the output transformer 314*b* determines the ratio of the current flowing through the light source 104*b* to the current flowing through the light source 104*c*. Further, other than the light source 104*a*, the output transformer 314*b* also determines the rate of the current, of the total current output by the power supply transformer 306, supplied to the light sources 104*b* and 104*c*. As a result, according to this example, even when the vehicle lamp 10 has three or more light sources 104, the current flowing through the light sources 104 can be appropriately designated.

As another example, for the vehicle lamp 10, first to N light sources 104 (N is an integer of two or greater) may be provided. In this case, the voltage output unit 202 applies a voltage to the N light sources 104 connected in parallel. For the power supply device 102, (N+1), first to (H−1)th, output transformers 314 are located between the voltage output unit 202 and the light sources 104.

The k-th (k is an integer satisfying $1 \leqq k \leqq N-1$) output transformer 314 includes: output coils 406 connected in series to the k-th light source 104, and (N-k) output coils 406, which are connected in series to the (k+1)th to the Nth light sources 104. In accordance with a current received from the voltage output unit 202, the (N-k) output coils 406 generate magnetic fluxes in a direction in which the magnetic fluxes generated by the output coils connected in series to the k-th light source 104 are canceled. With this arrangement, the ratio of the current flowing through the N light sources 104 can be appropriately designated.

Figure 12:
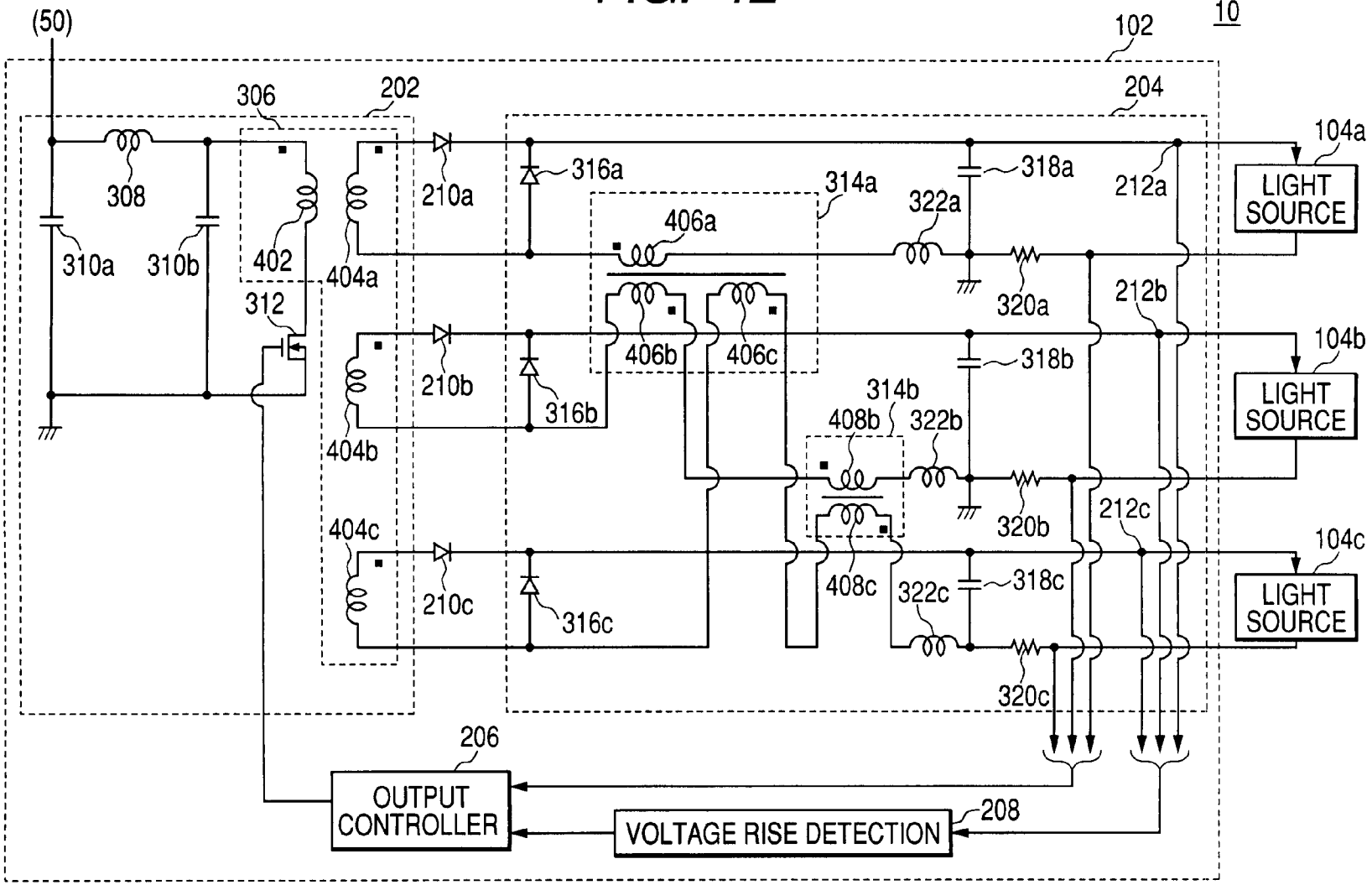
FIG. 12 is a diagram showing an additional example for the structure of the vehicle lamp.

FIG. 12 is a diagram showing an additional example for the structure of the vehicle lamp 10. Since the components in FIG. 12 denoted by the same reference numerals as are used in FIG. 1 or 11 have the same or corresponding functions, no further explanation for them will be given. In this example, the output coils 406 and 408 are provided downstream of the corresponding light sources 104, and the output coils are located downstream of corresponding series resistors 320. Further, the downstream ends of the series resistors are grounded. In this case, the ratio of the current flowing through the light sources 104 can also be appropriately designated.

As a further example, the cathode of the output current supply unit 210 may be grounded. In this example, the power supply transformer 306 outputs a negative voltage at the low potential output terminal of the secondary coil 404. In this case, the ratio of the current flowing through the light sources 104 can also be appropriately designated.

As is apparent from the above description, according to one embodiment of the invention, at each switch time for the switching device 312, the output controller 206 reduces to zero the minimum value of the current that flows through the output coil 406, so that the current can be supplied to the light sources 104 at a desired ratio. Further, since the output controller 206 increases, to more than twice the target value of the output current, the maximum value of the current that flows through the output coil 406, even when the minimum value of the current flowing through the output coil 406 is zero, the average value of the current supplied to the light sources 104 can easily be moved near the target value.

Furthermore, since the output controller 206 changes the switching frequency in accordance with the voltage supplied to the power supply transformer 306 and maintains the constant average current for the output coil 406, the average value of the current for the output coil 406 can be maintained without changing the maximum value of the current flowing through the output coil 406 at the time the switching device 312 is switched. In addition, when the target current supplied to the light source 104 is increased, the output controller 206 reduces the switching frequency for the switching device 312 and increases the average current for the output coil 406. Thus, the average value of the current for the secondary coil can be increased without changing the rate for increasing the current flowing through the output coil 406 at the time the switching device 312 is switched. The invention has been described by exemplary embodiments; however, the technical scope of the invention is not limited to these embodiments. It will be obvious for one having ordinary skill in the art that these embodiments can be variously modified or improved, and that such modifications or improvements are also included in the spirit of the invention. Accordingly, the invention is limited only by the attached claims.

We claim:

1. A vehicle lamp having a switching regulator, comprising:

a regulator transformer;

a primary switch for selectively supplying a current to the regulator transformer;

a plurality of semiconductor light-emitting devices connected in parallel to a secondary side of the regulator transformer;

a coupling transformer for magnetically coupling routes for the individual semiconductor light-emitting devices in a direction in which magnetic flux is offset by a current change;

a capacitor for smoothing a current flowing across the semiconductor light-emitting devices;

a semiconductor element for supplying a current in accordance with a leakage inductance of the coupling transformer to the semiconductor light-emitting devices when a current supplied to the semiconductor light-emitting devices from the regular transformer is decreased; and a control circuit for reducing to 0, each time a selection is made using the primary switch, a minimum value of an output current flowing the coupling transformer.

2. The vehicle lamp according to claim 1, wherein, regardless of a target value of the current to be supplied for the semiconductor light-emitting devices, or supply voltage on the primary side, the control circuit is maintained substantially constant for a period wherein an output current is 0 during a switching cycle time.

3. The vehicle lamp according to claim 1, wherein the control circuit increases a maximum value for the output current until larger than twice the target value of the currents to be supplied to the loads.

4. The vehicle lamp according to claim 3, wherein the control circuit changes switching frequencies in accordance with a voltage supplied by the primary side, the output current is maintained, regardless of the voltage supplied by the primary side.

5. The vehicle lamp according to claim 4, wherein, when a target value for a current to be supplied for the loads is increased, the control circuit reduces a switching frequency for the primary switch to increase the output current.

* * * * *